US005157225A

United States Patent [19]

Adams et al.

[11] Patent Number: 5,157,225

[45] Date of Patent: Oct. 20, 1992

[54] CONTROLLED FRAGMENTATION WARHEAD

[75] Inventors: John C. Adams; Thomas S. Smith; Joseph B. Bickley, all of Fredericksburg, Va.

[73] Assignee: The United States of America as represented by the Secretary of the Navy, Washington, D.C.

[21] Appl. No.: 486,475

[22] Filed: Apr. 19, 1983

[51] Int. Cl.[5] ..... F42B 12/24

[52] U.S. Cl. ..... 102/493

[58] Field of Search ..... 102/491–497, 102/506, 389

[56] References Cited

U.S. PATENT DOCUMENTS 2,411,862 12/1946 Arnold ..... 102/493
2,798,431 7/1957 Semon et al. .
3,000,309 9/1961 Zapf .
3,298,308 1/1967 Throner, Jr. ..... 102/496
3,566,794 3/1971 Pearson et al. .
3,799,054 3/1974 La Rocca .
3,820,464 6/1974 Dixon .
4,068,590 1/1978 Pearson .

FOREIGN PATENT DOCUMENTS 60985 9/1982 European Pat. Off. ..... 102/493

*Primary Examiner*—Harold J. Tudor
*Attorney, Agent, or Firm*—John D. Lewis; Jacop Shuster

[57] ABSTRACT

A controlled fragmentation explosive device is disclosed. Fragmentation control is achieved by providing both the inner and outer surfaces of a cylindrical case with intersecting longitudinal and circumferential "v" grooves having specific depth relationships. The inner and outer grooves are aligned with each other. The outer grooves are filled with a material for improving the acoustic impedence mismatch between the case and the volume within the "v" groove.

14 Claims, 1 Drawing Sheet

CONTROLLED FRAGMENTATION WARHEAD

BACKGROUND OF THE INVENTION

This invention relates to controlled fragmentation explosive devices. More particularly the invention relates to explosive devices having control over the size and shape of fragments produced by the device.

To avoid random distribution of fragments propelled by exploding anti-property and personnel devices, it is necessary to control the size, shape, and weight of the fragments. Small fragments have low mass and will not possess optimum amount of kinetic energy against a desired target compared to a larger mass fragment traveling at the same velocity. Large fragments, and in particular, bar, plate, and diamond shapes, however, offer more atmospheric drag causing the fragment velocity to slow down rapidly, resulting in a reduced kinetic energy on the target. It can be appreciated that inconsistant fragment size, shape and weight are undesirable.

Heretofore, fragmentation control has included providing grooves on either the external or internal surfaces of the wall of the case or a liner inserted into the case. The grooves create stress concentrations that cause the case to fracture along the grooves forming fragments. Generally these grooves are longitudinal, circumferential, or both, or constitute a series of intersecting helical grooves designed to produce diamond shape fragments. While these devices have demonstrated the ability to create fragments, they are not completely satisfactory for several reasons.

First, the fragments are often much smaller than they ordinarily should be due to fragment weight loss during the fragmentation process. Allowance for weight loss requires that the device be designed to produce larger fragments than will actually result. This reduces the number of fragments available for a given warhead.

Second, the prior art devices produce fragments of a variety of weights and do eliminate the variations in kinetic energy resulting therefrom. Additionally, diamond shaped fragments have high drag coefficients, which as stated, result in rapid decay of fragment velocity.

Casings that are relatively thick are susceptible to producing fragments of varying shapes and weights. The helical grooves heretofore utilized are ineffective in controlling these fragment variations.

Finally, during the fragmentation process much energy is wasted on metal deformation. Frequently, the corners of the fragments are turned up which further increases drag. It is desirable to provide the device with means for increasing the amount of energy directed to fragmentation rather than being wasted in fragment deformation.

SUMMARY OF THE INVENTION

Accordingly, it is an object of the invention to provide for a warhead having a high degree of fragmentation control for impacting a target with fragments of a uniform size and shape It is another object of the invention to provide for a fragmentation explosive device yielding fragments of uniform size and shape Another object of the invention is to provide for a fragmentation explosive device having an increased level of explosive force directed to producing fragments of a desired shape and size.

Another object of the invention is to provide for a fragmentation device that produces fragments having minimum drag characteristics A still further object of the invention is to provide for a fragmentation explosive device that maximizes the number of fragments produced in a specific weight group.

A further object of the invention is to provide for a fragmentation explosive device that maximizes the kinetic energy available from each fragment produced.

The objects are achieved and the limitations of the prior art are overcome by providing both the inner and outer surfaces of a cylindrical case with longitudinal and circumferential "v" grooves having specific dimensional relationships. The inner and outer grooves are preferably aligned with each other. The outer grooves are filled with a material for improving the acoustic impedance mismatch between the case and the air within the grooves thereon.

Other objects and attendent advantages of the invention will become apparent to those skilled in the art from reading the following detailed description of the preferred embodiment in conjunction with the accompanying drawings.

DESCRIPTION OF THE DRAWINGS

Referring to FIG. 1, there is shown a fragmentation explosive device 10 including a cylindrical case 12 for holding an explosive, not shown. Case 12 is normally of steel construction and includes circumferential grooves 14 on its outer surface and circumferential grooves 16 on its inner surface. Circumferential grooves 14, 16 are preferably radially aligned with each other forming individual circumferential groove pairs. As best shown in FIG. 2, cylinder case 12 is also provided with outer longitudinal grooves 18 and inner longitudinal grooves 20 which are also radially aligned with each other forming individual longitudinal groove pairs. Longitudinal grooves 18, 20, intersect circumferential grooves 14, 16, to form the grid patterns shown in FIG. 3. While the preferred embodiment has longitudinal grooves 18, 20, parallel to the longitudinal axis of case 12 they may be skewed therefrom to change the pattern of ejection of the fragments. The inner and outer circumferential grooves have an included angle falling within 30° to 60° and are preferably 45°.

Figure 1:
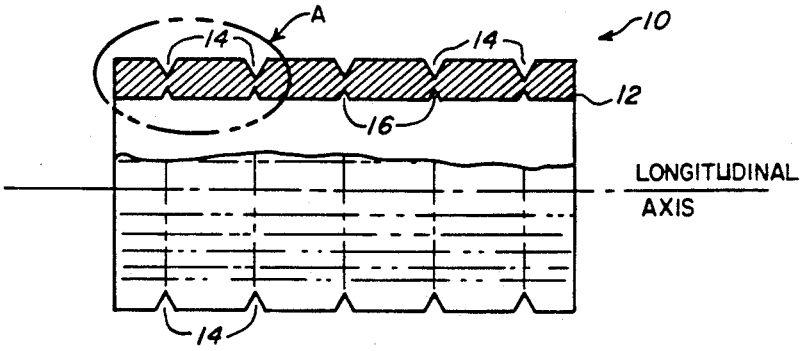
FIG. 1 is a fragmentary longitudinal section of the preferred embodiment showing the inner and outer circumferential grooves.
Figure 2:
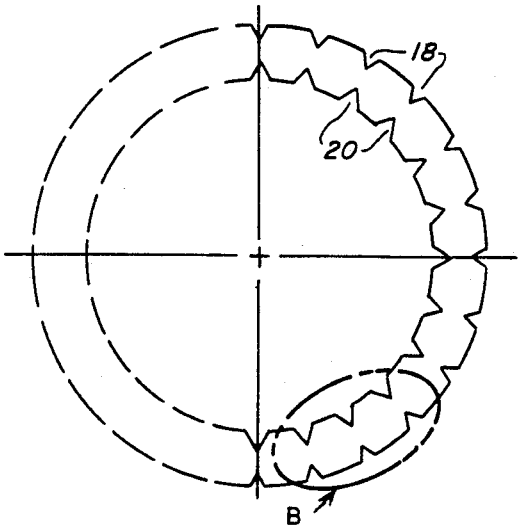
FIG. 2 is an end view of the preferred embodiment showing the inner and outer longitudinal grooves.
Figure 3:
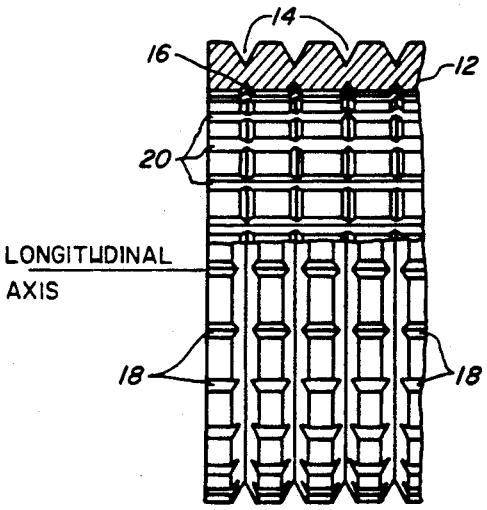
FIG. 3 is a fragmentary partial longitudinal cross section of the preferred embodiment showing the inner and outer surface grid patterns.

Likewise, the inner and outer longitudinal grooves have an included angle falling within 30° to 60° and are preferably 45°.

It has been found that to achieve uniform fragment size and shape, and to assure that substantially all of the fragments fall within the same desired weight group, a relationship exists between the depths of the various grooves. During detonation of case 12, strain is greatest in the circumferential direction and fracture of longitudinal grooves 18, 20, will occur more readily than along circumferential grooves 14, 16. Therefore, circumferential grooves 14, 16, are made deeper than the longitudinal grooves. It has been found that a high degree of fragmentation size, shape and weight control is achieved by making outside circumferential grooves 14 deeper than inside circumferential grooves 16 by a ratio of 2:1. The relationship between inside and outside longitudinal grooves 20, 18, is less critical; however, it has been found that improved fragmentation control is achieved by making the inside longitudinal grooves deeper than the outside longitudinal grooves by a ratio of 3:2. Additionally, the ratio of the total depth of any circumferential groove pair to the total depth of any longitudinal groove pair, also referred to as the groove depth ratio, must be greater than 2:1. As the data presented below shows, as the groove depth ratio falls below 2:1 less than optimum fragmentation control takes place.

The above specific depth ratios are applicable to warhead casings made of low carbon steel which is readily available, inexpensive and easily machined. When other materials are used the same fragmentation control technique and general relationships between the various groove depths as disclosed herein are applicable thereto. Only the specific numerical values of the depths of the grooves applicable to the specific material used must be determined. Those skilled in the field of controlled fragmentation devices will readily be able to determine the specific depths of the various grooves for other materials having the benefit of the general relationships therebetween as taught in this disclosure.

Figure 4:
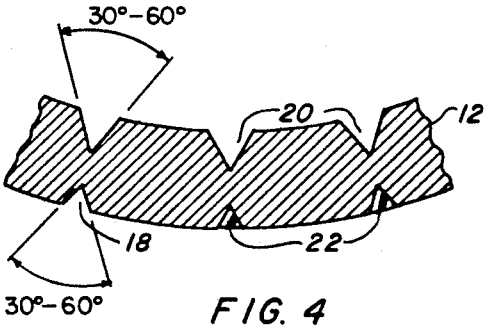
FIG. 4 is an enlarged view of B in FIG. 2 showing details of the inner and outer longitudinal grooves.
Figure 5:
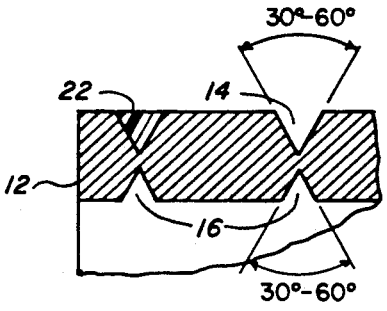
FIG. 5 is an enlarged view of A on FIG. 1 showing details of the inner and outer circumferential grooves.

While the exact mechanism is not conclusively known, it has been determined that by filling the external grooves of the case with a material 22, see FIGS. 4 and 5, as disclosed herein, control over the size, shape and weight of the fragments is improved. It is known that as the device detonates, shockwaves travel through case 12. Because the acoustic impedance of the air within the groove and the steel case are substantially different, the shockwaves impinge upon and are reflected from the interface of the case wall outer surface with circumferential grooves 14 and outer longitudinal grooves 18. The impingement and reflection causes the grooves to collapse and deform creating fragments with turned up edges as hereinabove mentioned. Additionally, reflected shockwaves causes spalling of the metal case resulting in fragments having uneven, rough, and non-uniform size and weight. By filling the grooves with a material having an acoustic impedance substantially matching that of the case, the acoustic impedance mismatch between the material in the grooves and case is reduced which diminishes the reflected shockwaves and reduces spalling of the metal. The material in the grooves helps prevent groove collapse, deformation and metal spalling, leaving smooth, uniform shaped and weight fragments. Any material that has an acoustic impedance substantially matching that of the case, or at least being between that of air and the case, and which is preferably in a fluid or semi-fluid state for easy filling of the grooves, can be used. Representative materials are epoxy, iron filled epoxy, or a urethane. These materials are representative only and are not to be considered all inclusive.

The test data presented herein shows the effectiveness of the present invention. The warheads tested had relatively thick, low carbon, steel wall cases ranging from 0.35 to 0.40 inches. The cases were loaded with high explosive and initiated from the center of one end. The warhead was placed vertically in an area of CELOTEX bundles located 20 feet from the warhead to catch the fragments.

Referring to Table I, tests 1 and 2 substantiate the conclusion that making the outer circumferential groove deeper than the inner circumferential groove by approximately 2:1 produces a considerably larger percentage of fragments in the desired weight range.

As shown in Table II, tests 3, 4, and 5 substantiate the conclusion that an increased percentage of fragments fall within the desired weight range by filling the exterior circumferential and longitudinal grooves with either urethane or iron filled epoxy. Additionally, visual inspection of the fragments from filled and unfilled grooves showed that those from the warhead having unfilled exterior grooves had considerable plastic metal flow and irregular surfaces as compared to the fragments from the warhead having its exterior grooves filled.

Referring to Table III tests 6–10 substantiate the conclusion that substantially all of the fragments produced by the warhead will fall within the desired weight group by making the groove depth ratio, as defined hereinabove, greater than approximately 2:1. As shown in the data for tests 6 and 7, when the groove depth ratio falls substantially below 2:1, multiple fragments are formed and less than 50% of the total fragments produced fall in the desired weight group. Multiple fragments are those that occur when a complete fracture of a longitudinal or circumferential groove between adjacent columns or rows does not take place. The failure of the grooves to fracture when the warhead is exploded results in a larger fragment made up of 2, 3, or more smaller fragments of the desired size but which failed to separate. Test 8 again substantiates the effectiveness of filling the exterior grooves as evidenced by the increased number of fragments falling in the desired weight group even though the groove depth ratio is less than the preferred ratio of 2:1. Finally, as shown in tests 9 and 10, when the groove depth ratio is substantially close to the preferred ratio of 2:1, effective fragmentation control occurs as evidenced by more than 95% of the fragments falling in the desired weight group.

Having described the preferred embodiment of the invention, other embodiments and modifications will readily come to the mind of one skilled in the art of controlled fragmentation devices. It is therefore to be understood that this invention is not limited thereto and that said modifications and embodiments are to be included within the scope of the appended claims.

TABLE 1

| Test | Circumferential Notch Depth, in. Inside/Outside | Total Weight of Recovered Fragments, gm Group | % of Fragment Weight in 13.4–17.5 gm | Fragment Design Weight, gm | Wall Thickness in. |
|---|---|---|---|---|---|
| 1. | .070 .150 | 389.8 | 79.1 | 14.5 | .35 |

TABLE 1-continued

| Test | Circumferential Notch Depth, in. Inside/Outside | Total Weight of Recovered Fragments, gm Group | % of Fragment Weight in 13.4–17.5 gm | Fragment Design Weight, gm | Wall Thickness in. |
|---|---|---|---|---|---|
| 2. | .150 .070 | 368.7 | 32.0 | 14.5 | .35 |

Inside and Outside Longitudinal Notch Depth: 0.100 in

TABLE 2

| Test | Notch Filler | Average Fragment Weight, gm | % of Recovered Fragment Weight in 5.8–8.4 gm group | Fragment Design Weight, gm | Circumferential Notch Depth, in. Inside | Circumferential Notch Depth, in. Outside | Longitudinal Notch Depth, in. Inside | Longitudinal Notch Depth, in. Outside |
|---|---|---|---|---|---|---|---|---|
| 3 | Urethane | 7.15 | 57.8 | 7.8 | .075 | .160 | .060 | .100 |
| 4 | 50% Iron Filled Epoxy | 6.40 | 59.3 | 7.8 | .075 | .160 | .060 | .100 |
| 5 | Unfilled | 5.62 | 40.0 | 7.8 | .075 | .160 | .060 | .100 |

TABLE 3

| Test | Circumferential Notch Depth, in. Inside | Circumferential Notch Depth, in. Outside | Longitudinal Notch Depth, in. Inside | Longitudinal Notch Depth, in. Outside | Total Weight of Recovered Fragments, gm | % of Fragment Weight in 13.5–17.5 gm group | % of Multiple Fragment by weight | Fragment Design Weight gm | Circumferential to Longitudinal Notch Depth Ratio |
|---|---|---|---|---|---|---|---|---|---|
| 6 | .072 | .189 | .099 | .059 | 1902.2 | 43.6 | 25.0 | 15.5 | 1.652 |
| 7 | .072 | .187 | .110 | .070 | 1626.0 | 42.5 | 29.3 | 15.5 | 1.439 |
| 8* | .079 | .175 | .083 | .059 | 762.8 | 68.8 | 0 | 14.5 | 1.789 |
| 9 | .106 | .208 | .105 | .052 | 864.4 | 95.4 | 0 | 15.2 | 2.000 |
| 10 | .093 | .194 | .091 | .054 | 746.6 | 98.3 | 0 | 15.2 | 1.979 |

*0.375 in. wall thickness; all others 0.400 in.
NOTE: Exterior notches filled with epoxy.

We claim:

1. A controlled fragmentation explosive device comprising:

a cylindrical case having inner and outer wall surfaces and a longitudinal axis, said case adapted to hold an explosive for impulse loading the wall;

a plurality of circumferential and longitudinal grooves on the inner and outer wall surfaces disposed perpendicular and parallel to the longitudinal axis respectively, said inner surface grooves being in radial alignment with corresponding outer surface grooves forming circumferential and longitudinal groove pairs, the depths of all of said grooves defined by relationships including;

said inner and outer surface circumferential grooves being deeper than said corresponding inner and outer longitudinal grooves;

said outer surface circumferential grooves also being deeper than said inner surface circumferential grooves, and the total depth of each circumferential groove pair exceeds the total depth of each corresponding longitudinal groove pair.

2. The device as defined in claim 1 further including means for altering the acoustic impedance of said outer surface circumferential and longitudinal grooves to substantially match the acoustic impedance of said case providing for reduction in shockwave creation within said outer grooves, whereby said case fractures along said inner and outer surface longitudinal and circumferential grooves forming fragments having minimum deformation.

3. The devices as defined in claim 2 wherein said means for altering the acoustic impedence of said outer surface grooves includes filling said outer surface grooves with an iron filled epoxy resin.

4. The device as defined in claim 2 wherein said means for altering the acoustic impedance of said outer grooves includes filling said outer grooves with a urethane.

5. The device as defined in claim 1 wherein said case is low carbon steel.

6. The device as defined in claim 5 wherein said outer surface circumferential grooves are deeper than said inner surface circumferential groove by a ratio of 2:1, and the total depth of each circumferential groove pair is greater than the total depth of each corresponding longitudinal groove pair by a ratio of 2:1 or more with the preferred, ratio being 2:1.

7. The device as defined in claim 6 further having said inner surface longitudinal grooves deeper than said outer surface longitudinal grooves by a ratio of 3:2.

8. A controlled fragmentation explosive device comprising:

a cylindrical case having a longitudinal axis, an inner and an outer surface adapted to contain an explosive therein for impulse loading the surfaces;

a plurality of equally spaced equal depth circumferential grooves on the outer surface disposed perpendicular to the longitudinal axis;

a plurality of equally spaced equal depth longitudinal grooves on the outer surface disposed parallel to the longitudinal axis;

a plurality of equal depth circumferential grooves on the inner surface orientated in radial alignment with said circumferential grooves on the outer surface; and, a plurality of equal depth longitudinal grooves on the inner surface orientated in radial alignment with said longitudinal grooves on the outer surface, the depths of all of said grooves being interrelated for controlling fragmentation along said grooves, the interrelation including said outer circumferential grooves being deeper than both said inner surface circumferential grooves and said outer surface longitudinal grooves, and the sum of the depths of any one of said outer and inner surface circumferential grooves exceeds the sum of the depths of any one of said outer and inner longitudinal grooves.

9. The device as defined in claim 8 further including means for altering the acoustic impedance of said outer surface circumferential and longitudinal grooves to substantially match the acoustic impedance of said case providing for reduction in shockwave creation within said outer grooves, whereby said case fractures along said inner and outer surface longitudinal and circumferential grooves forming fragments having minimum deformation.

10. The device as defined in claim 9 wherein said means for altering the acoustic impedance of said outer surface grooves includes filling said outer surface grooves with an iron filled epoxy resin.

11. The device as defined in claim 9 wherein said means for altering the acoustic impedance of said outer surface grooves includes filling said outer surface grooves with a urethane.

12. The device as defined in claim 8 wherein said case is low carbon steel.

13. The device as defined in claim 12 wherein said outer surface circumferential grooves are deeper than said inner surface circumferential grooves by a ratio of 2:1, and the sum of the depth of one of said outer and inner surface circumferential grooves exceeds the sum of the depth of one of said outer and inner longitudinal grooves by a ratio of 2:1 or more, and preferably by the ratio equal to 2:1.

14. The device as defined in claim 12 further having said inner surface longitudinal grooves deeper than said outer surface longitudinal grooves by a ratio of 3:2.

* * * * *